US005769417A

United States Patent [19]

Richer et al.

[11] Patent Number: 5,769,417

[45] Date of Patent: Jun. 23, 1998

[54] BLACKJACK PRIMER

[76] Inventors: Ned A. Richer, 4954 W. 13th St., Speedway, Ind. 46224-6520; Pamela Sue Cole, 3117 Danbury Rd., Indianapolis, Ind. 46222

[21] Appl. No.: 896,956

[22] Filed: Jul. 18, 1997

Related U.S. Application Data

[60] Provisional application No. 60/026,298, Sep. 11, 1996.

[51] Int. Cl.[6] ..... A63F 1/18

[52] U.S. Cl. ..... 273/148 R

[58] Field of Search ..... 273/292, 302, 273/148 R

[56] References Cited

U.S. PATENT DOCUMENTS

| | | | |
|---|---|---|---|
| 1,486,313 | 3/1924 | Van Antwerp . | |
| 3,924,340 | 12/1975 | Tammone . | |
| 3,962,800 | 6/1976 | Feldheim . | |
| 4,052,073 | 10/1977 | Miller . | |
| 4,266,770 | 5/1981 | Yeager . | |
| 4,402,509 | 9/1983 | Dersher . | |
| 4,526,371 | 7/1985 | Venditti . | |
| 4,778,183 | 10/1988 | Luisi . | |
| 5,603,499 | 2/1997 | Jagosz | 273/148 R |
| 5,628,511 | 5/1997 | Jacoby | 273/148 R |

FOREIGN PATENT DOCUMENTS

| | | |
|---|---|---|
| 2595260 | 9/1987 | France . |
| 667814 | 11/1988 | Switzerland . |

*Primary Examiner*—William E. Stoll
*Attorney, Agent, or Firm*—Richard C. Litman

[57] ABSTRACT

A small, hand held, pocket size blackjack primer provides recommended actions for a blackjack player, depending upon the cards dealt to the player and the single open or face up card of the dealer. The device comprises an inner cylinder with a table of recommended actions therearound, and an outer cylinder with a single elongate window therein providing a view of a single row of recommended actions on the table at one time. A knob is provided at each end of the cylinder, to turn the table to an appropriate position. A position for the dealer's face up card and various combinations of the player's cards is provided adjacent the window. The player need only note the dealer's face up card and turn one of the knobs to position that value beneath the dealer card portion of the window, and then read the appropriate recommended action (hit, stand, double down, or split a pair) beneath his or her card value appearing in the window. Additional features may be provided for convenience, such as color coordination of the appropriate recommended actions on the table and in the legend on the outer cylinder, a convex lens in the window to magnify the table, a flat base to prevent rolling of the cylindrical device, and/or a keychain at one end thereof. The device is not a computer, as no numbers are manipulated, but serves as a primer or aid to the player for the optimum action at any point in the game.

20 Claims, 3 Drawing Sheets

BLACKJACK PRIMER

REFERENCE TO RELATED PATENT APPLICATION

This application claims the benefit of U.S. patent application Ser. No. 60/026,298, filed on Sep. 11, 1996.

BACKGROUND OF THE INVENTION

1. Field of the Invention

The present invention relates generally to memory aids and devices, and more specifically to a gambling assistance device which includes a table serving as an indicator for the appropriate action to be taken when specific cards are drawn by the dealer and player in a game of blackjack or twenty one. The device is not a calculator, but rather serves as a memory assistance device, reminding the player of the best action to be taken under any given circumstances. The player turns a dial at one end of the cylindrical device, to cause the player cards to appear at one end of an elongate window. The various possible dealer hands are represented adjacent the window. The action to be taken by the player will be indicated in the window, beneath each of the possible dealer hands.

2. Description of the Prior Art

The game of blackjack, also known as twenty one, is a relatively simple gambling game using a standard (or "poker") deck of fifty two playing cards having "spot" or numbered cards from one (or ace) through ten and three "face" cards (jack, queen, and king) in each of four suits. The "spot" cards are counted according to their face value, with the ace being worth either one or eleven as the dealer or player wishes. Face cards are worth ten points each.

The game is played by a dealer and one or more players. Minor variations in the rules may occur between different casinos or governing authorities where such games are regulated, but the general rules are universal. Generally, each player places a bet and the dealer deals out a first card face down to each player, with the dealer receiving his/her first card face up. The object of the game is to arrive at a hand of two or more cards having a total value as close to twenty one as possible, without exceeding that value. A hand exceeding twenty one is a losing hand, or "bust." Each player has the option of asking for a third (or more) card(s), in order to attempt to raise the total count of his/her hand closer to twenty one without going over. The dealer must play according to established rules in casino play, and is required to draw another card if his/her two card hand is below a certain value (generally seventeen) and must "stand" on the initial two cards if the hand is at or above that value. The player or dealer having a hand closest to twenty one wins, with ties generally being awarded to the dealer to provide an "edge" to the casino or house.

Other variations on the above general rules are usually employed in casino play, such as "splitting pairs," in which a player is allowed to form two hands from an initial single hand having identically valued cards therein, and "doubling down," where a player may turn his/her down card face up and double his/her bet, and draw only one additional card. Thus, while the basic rules are relatively simple, the decisions which must be made can be complex. While some highly experienced players can remember the best course of action to take with each combination of cards dealt to that player and the dealer, the average player will generally make some less than optimum decisions fairly frequently. This results in a further reduction in the player's chances of winning, with the odds being slightly in favor of the house even when a player makes the right decision at each point.

Accordingly, various devices, calculators, etc. have been developed in the past to assist players in making optimum decisions during the course of play of blackjack or twenty one. However, most of these devices are relatively complex, and/or rely upon some electronic operation, for their function. The present blackjack primer is not closely related to the various devices of the prior art of which the inventors are aware, as will be shown in the discussion of that prior art below.

U.S. Pat. No. 1,486,313 issued on Mar. 11, 1924 to Edith Van Antwerp describes a Score Calculating Device for calculating the doubling of bonus scores in the game of Mah Jongg. The device comprises an inner and an outer cylinder, with the inner cylinder having a single turning knob with base scores marked thereon and a table of doubled and redoubled scores for each of the corresponding base scores marked thereon. An elongate window is formed in one side so the doubled and redoubled scores may be read. The device is a calculator somewhat like a cylindrical slide rule, unlike the present invention which indicates which action of multiple possibilities should be taken. Van Antwerp fails to disclose a base or other features of the present device.

U.S. Pat. No. 3,924,340 issued on Dec. 9, 1975 to John M. Tammone describes a Blackjack Teaching Device, comprising a rectangular housing (not cylindrical) with a plurality of windows along the top thereof. An inner cylindrical table is installed within the housing, with a turning knob extending from each end of the housing. The Tammone device is generally inverted from the present device, in that Tammone indicates the single face up card of the dealer on the table, visible through one of the windows, while the present blackjack primer indicates the dealer's possible up cards in a row across the outer cylinder, with each possible card corresponding to a column of the internal table. Tammone indicates the action to be taken on a row of instructions on the outer housing, with the player cards (or some further instruction) being viewed through the window(s). The result is a somewhat confusing device with a simplified table and additional instructions relating to the splitting of pairs being marked on the housing. The simplified table of Tammone also requires that a player recognize the difference between "hard" and "soft" hands, where a "soft" hand has a variable value due to the variable value of an ace held therein. The present device does not require the player to concern him or herself with additional details such as this. Also, no color coding or magnification is provided by Tammone, as is provided by the present device.

U.S. Pat. No. 3,962,800 issued on Jun. 15, 1976 to Robert J. Feldheim describes a Teaching Device Particularly Adapted For The Game Of Blackjack. The device is actually an electronic simulator using relatively complex electronic circuitry and components, rather than being a primer or memory aid as is the present device. The Feldheim device does nothing to indicate the proper choice beforehand, but rather only indicates whether a choice made by the player is correct or incorrect, after it has been made. The Feldheim device is not used in an actual game. If it were, then there would be no need for any right or wrong indication after a decision was made, as the correctness of a decision would be apparent and the player would be rewarded or penalized for such decisions according to the amount wagered. The present device shows the player the proper course of action, rather than requiring the player to make the decision.

U.S. Pat. No. 4,052,073 issued on Oct. 4, 1977 to Franklin E. Miller describes a Blackjack Play Director comprising a complex electronic device having a keyboard for separate entry of the dealer's face up card and the player's initial two cards. One of four possible decisions (stand, double down, split, or hit) is indicated by a light after the last card is entered. The device is more closely related to the Feldheim complex electronic device discussed above, than to the present blackjack primer device.

U.S. Pat. No. 4,266,770 issued on May 12, 1981 to Charles A. Yeager describes a Blackjack 21 Computer, comprising a short cylindrical disk with a pair of levers mounted therein. The levers are retained by detents corresponding to the value of cards played in the course of the game, with the device serving as a memory aid to keep track of the values of cards played by means of the positions of a pair of pins extending from the levers. The device may be carried inconspicuously so as not to attract attention, with the player using the device tactilely. However, the device does nothing to remind or inform the player as to what action should be taken at any point. The player must select the action with no assistance from the Yeager device, other than its provision for keeping track of cards.

U.S. Patent No. 4,402,509 issued on Sep. 6, 1983 to Charles L. Dersher describes a Dice Throwing Craps Game Computer, comprising a device similar to a circular slide rule. The device serves to provide the user with a recommended betting action, but is limited to only one type of all of the possible wagers which might be placed in the game of craps. The present device includes a recommended action for all of the possibilities in the game of blackjack. The Dersher computer is a thin, flat, circular device formed of two concentrically rotatable discs, unlike the present generally cylindrical blackjack primer. Moreover, the present device is not a calculator or computer, as no odds are calculated. The present device provides a recommended action by the player depending upon the cards held by the dealer and player.

U.S. Pat. No. 4,526,371 issued on Jul. 2, 1985 to Arthur P. Venditti describes a Spelling Game in which a cylindrical table of randomly selected letters is placed on a pen, pencil, or other elongate cylindrical object, with a cursor being placed thereover. The cursor includes several windows through which groups of the letters may be seen on the table. The object is to make up as many words as possible using the limited letters visible through one of the windows. No suggested actions are provided by the device, as is done using the present blackjack primer, nor is the device related to any card or gambling games, as is the present device.

U.S. Pat. No. 4,778,183 issued on Oct. 18, 1988 to William P. Luisi describes a Blackjack Strategy Device comprising a cylindrical tube having a table disposed therearound. The table indicates to the player whether he/she should stand, hit, double, or split a pair. However, the table orientation is different from that of the present device, requiring that the cylinder be upended for legible orientation. A separate window is provided for the dealer's up card, whereas the present device uses a single window for dealer's card and player's cards for economy. As the Luisi device must be on end to be read normally, Luisi has no motivation to provide any means along the cylinder to prevent rotation of the cylindrical device to preclude its rolling from a table, as is provided by the present device. Also, Luisi fails to provide colors for different actions, as is provided by the present device.

French Patent Publication No. 2,595,260 published on Sep. 11, 1987 illustrates a device used for scoring in contract bridge. The device comprises a long, thin cylindrical tube having a cylindrical table therein with a ball point pen cartridge coaxially installed therein. The outer tube may be rotated relative to the inner table to determine the point values of bids, overtricks, and undertricks in various suits or notrump contracts. The device does not provide any recommended actions on the part of the user, as is provided by the present blackjack primer. No separate dealer and player hands or windows are provided, as it is the winning bidder, rather than the dealer, who is playing against the opposing players in contract bridge. The present device is not a calculator and does not calculate point values, but rather provides recommended actions for blackjack players depending upon the cards dealt. No base support, double opposite knobs for turning the inner table relative to the outer sleeve, or color coding are disclosed by the French disclosure, all of which are provided by the present device.

Finally, Swiss Patent Publication No. 667,814 published on Nov. 15, 1988 illustrates a calculator for card games, which is in actuality a score recording device. Separate scales are provided for the tens and single digits for opposing sides, with the scales being alignable to indicate the two digit score for each side. No recommended actions are provided by the device, as provided by the present blackjack primer.

None of the above inventions and patents, either singly or in combination, is seen to describe the instant invention as claimed.

SUMMARY OF THE INVENTION

The present invention is a blackjack primer, or device for indicating the proper course of action for a player in a game of blackjack or twenty one to maximize his or her chances of winning. The device comprises a generally cylindrical housing having an elongate window therein, through which a predetermined line of a table may be viewed. The table is affixed to an inner cylinder, which is rotated within the outer cylinder to position the proper line of instructions beneath the window, according to the cards dealt to the player using the device. The device is pocket sized an may include additional conveniences such as a key chain, etc.

Accordingly, it is a principal object of the invention to provide an improved blackjack primer which provides recommended actions on the part of a player, according to the cards dealt to the player and the open or face up card of the dealer.

It is another object of the invention to provide an improved blackjack primer which comprises a generally cylindrical device devoid of electrical and electronic components.

It is a further object of the invention to provide an improved blackjack primer which includes a cylindrical table of recommended actions therein, which table is selectively rotatable by two selection knobs at opposite ends of the device.

An additional object of the invention is to provide an improved blackjack primer which is pocket sized and which may be held in the palm of the hand, and which may further include a keychain for further utility thereof.

Still another object of the invention is to provide an improved blackjack primer which may include further convenience features, such as color coding of the table recommendations, a magnifying lens, and a flat base to preclude rolling of the device.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
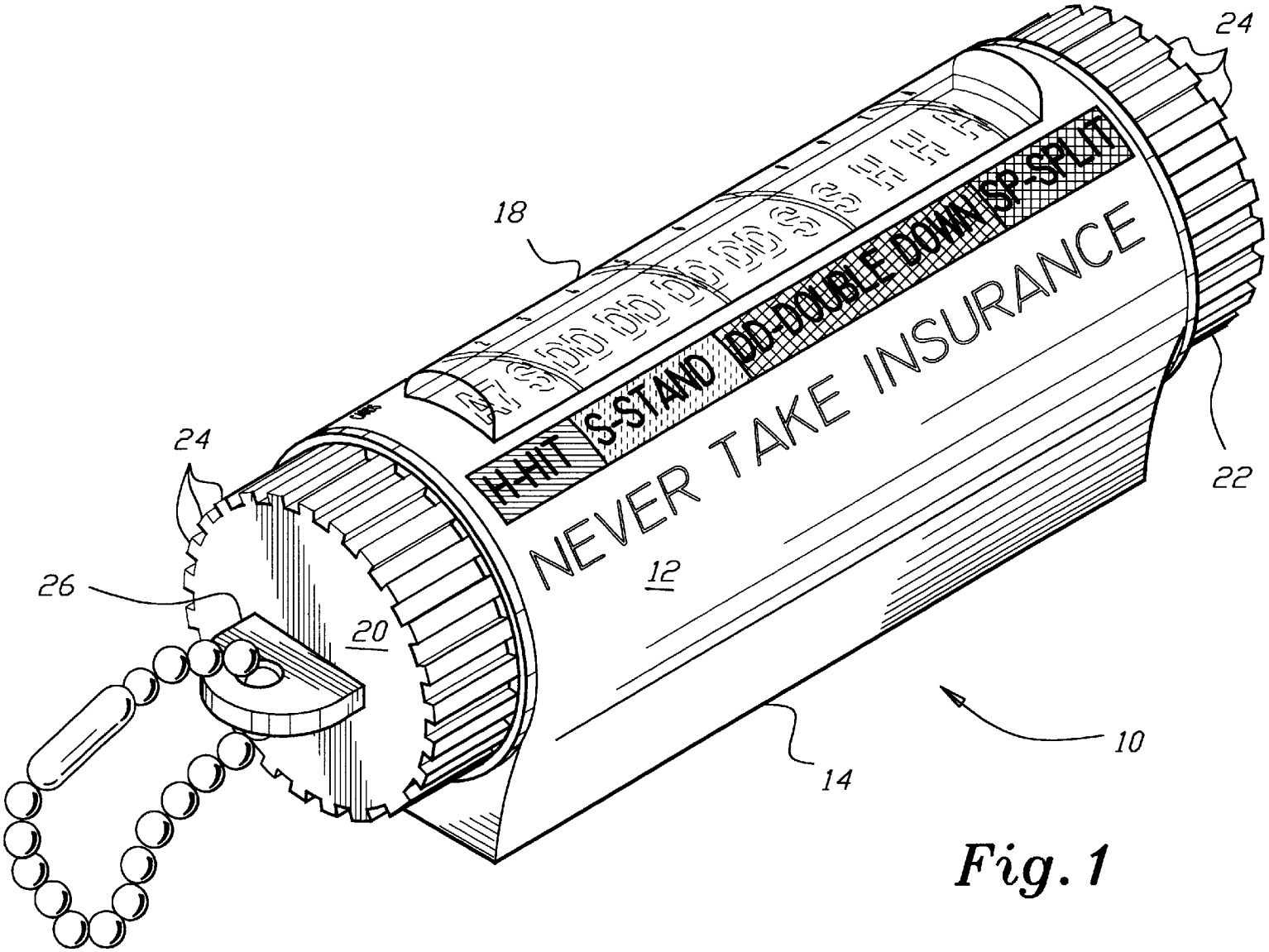
FIG. 1 is an enlarged perspective view of the present blackjack primer, showing its general configuration and various details thereof.
Figure 2:
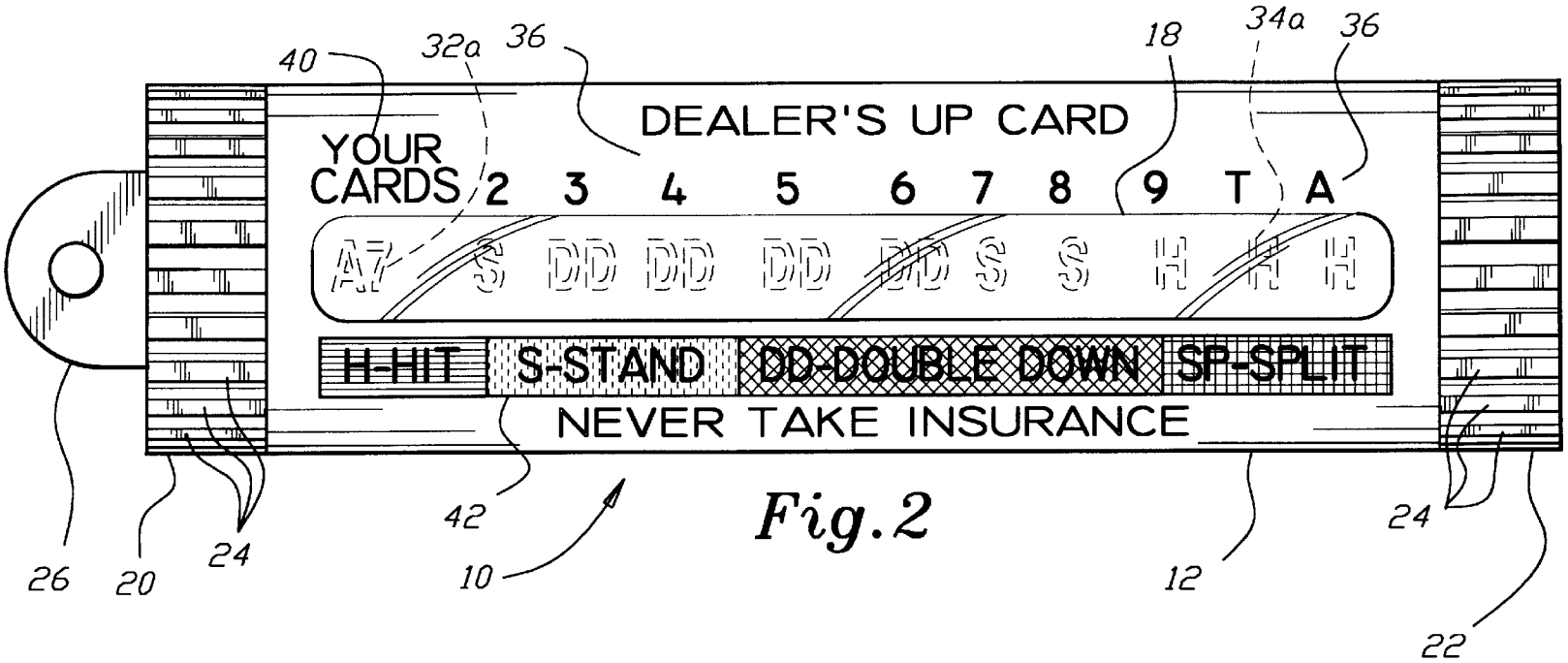
FIG. 2 is an enlarged top plan view of the present blackjack primer.
Figure 3:
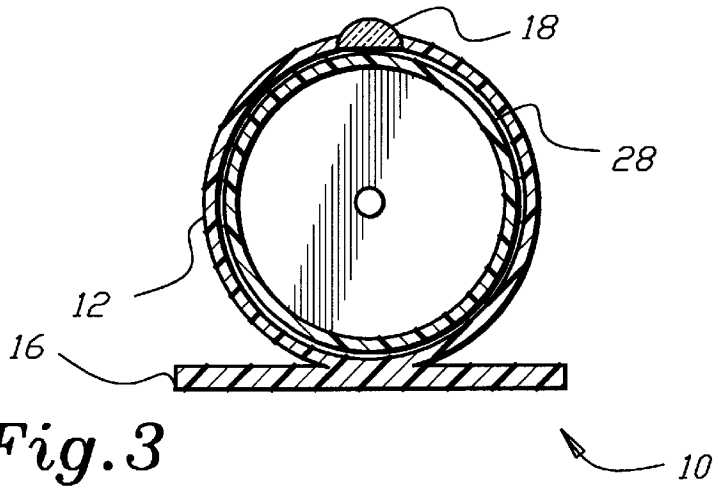
FIG. 3 is an enlarged elevation view in section of the present device, showing various internal details of its construction.

The present invention comprises a small, hand held, pocket size blackjack primer 10, shown in an enlarged scale in the perspective view of FIG. 1 and the top plan view and elevation view in section respectively of FIGS. 2 and 3. The blackjack primer 10 provides an easy to use means of quickly determining the optimum action in a game of blackjack or twenty one, depending upon the single face up card of the dealer and the initial two cards dealt to the player. As the typical professional game is very fast paced and offers numerous decision points during play, the present primer 10 will be seen to be most useful to a player of the game.

The present blackjack primer 10 comprises an outer housing 12, which is generally cylindrical in shape as can be seen in the elevation view in section of FIG. 3. A flat base 14 (FIG. 1) or flange 16 (FIG. 3) may be provided along the length of the housing 12, to preclude rolling of the otherwise cylindrical housing 12 on a flat surface when the primer 10 is placed thereon.

The housing 12 also includes a single elongate window 18 extending along at least the majority of the length of the housing 12, and generally opposite the base 14 or flange 16. The window 18 is preferably a clear, transparent piece of plastic material (or alternatively glass, for scratch resistance), and preferably is formed as a convex magnifying lens, as shown in cross section in FIG. 3, in order to enlarge the elements shown on the table within the outer housing 12.

A first and an opposite second selection knob, indicated respectively as 20 and 22, extend from each end of the outer housing 12. These two knobs 20 and 22 may be provided with knurls or ridges 24 or may be otherwise formed to provide a good grip for a user of the present blackjack primer 10, if desired. At least one of the knobs, e. g., the first knob 20, may include a keychain tab 26 extending therefrom if desired, to add further utility to the device. As the present blackjack primer 10 is relatively small, having an overall length of some three and one half inches including the outer housing 12 and the two opposite knobs 20/22 and a diameter on the order of one inch, it may be carried easily in a pocket and may be used as a keychain ornament.

Figure 4:
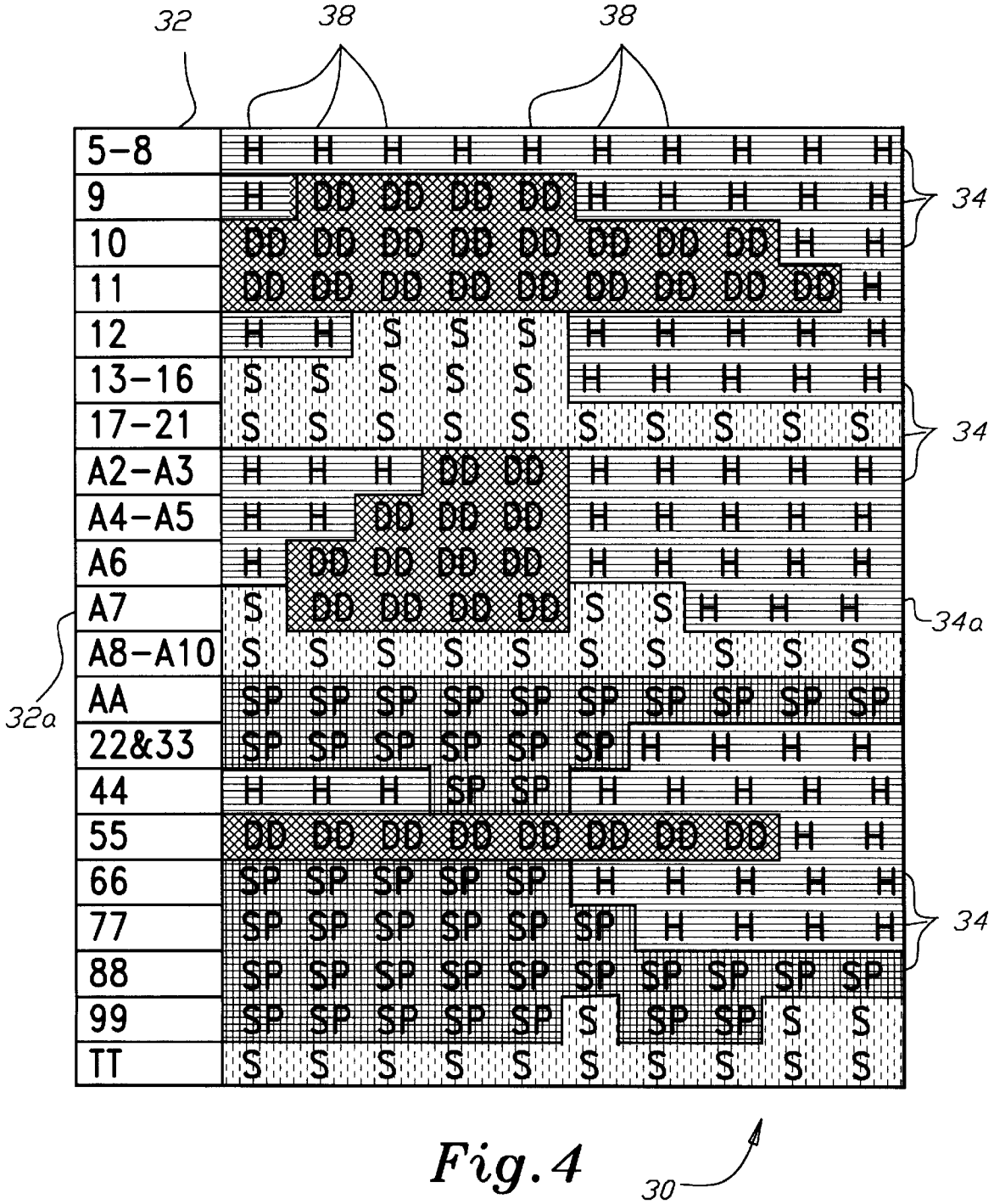
FIG. 4 is an enlarged plan view of the recommended action table disposed upon the internal cylinder of the present device, showing the recommendation indicators thereon and the color coding thereof.

The inner cylinder 28, shown in section in FIG. 3, is installed concentrically within the outer housing 12 and includes a table 30 of recommended actions thereon, which table 30 is disclosed in its entirety as an enlarged flat sheet in FIG. 4. The table 30 includes a first column 32, listing all possible two card combination counts which might be held by a player after the initial deal, before making any further decisions as to the further play of the hand. These two card combinations in the first column 32 are somewhat condensed, with those possible combinations not including aces or pairs being indicated by their total count. In other words, the first place in the first column 32, with the notation "5–8," represents various combinations of two cards having a total count between five and eight, i. e., a two and a three, a three and a four, a three and a five, etc. Again, pairs and aces would not be included here, as different recommended actions apply to those specific hands and are shown in other places in the first column.

To the right of the vertical column 32 is a series of rows 34 listing recommended actions corresponding to the card combinations of each place in the column 32. A single card combination held by the player may still require one of several actions by the player, depending on the single face up card of the dealer's hand. Accordingly, a dealer card row 36 is displayed on the outer surface of the outer housing 12, adjacent the window 18. The dealer card row 36 has a position for each possible card value from two through ten (including face cards) and ace with each position corresponding to one of the columns 38 of suggested actions on the table 30.

The selection knobs 20 and 22 shown in FIGS. 1 and 2 are affixed to the inner cylinder 28 shown in section in FIG. 3. Thus, the inner cylinder 28, with its table 30 affixed therearound, may be selectively rotated within the outer housing 12 by turning one or both of the knobs 20/22, to cause the appropriate two card combination count of the first column 32 of the table 30 to appear in the left end of the window 18, beneath the "your cards" designation 40 immediately adjacent the left end of the window 18 on the outer housing 12.

In the example shown through the window 18 in FIG. 2, The player has selected the card count combination "A7," designating an ace and a seven, as shown in the left end of the window 18 and indicated by the designation 32*a*, corresponding to the same point 32*a* of the player cards row 32 in the table 30 of FIG. 4. To the right of this card combination is a row 34*a* of recommended actions corresponding to the card combination 32*a*. It will be seen that several different recommended actions are shown in this row 34*a*, each represented by the letter or letters "S" (for "Stand"), "DD" ("Double Down"), and "H" ("Hit"). One other possibility exists, and is shown in the rows corresponding to several of the higher valued pairs toward the bottom of the table 30. This is designated as "SP" ("Split"). A legend 42 is provided on the outer housing 12, immediately adjacent the window 18, defining the abbreviated symbols "H," "S," "DD," and "SP" used in the table 30.

In the above example, the player holding an ace and a seven, and having dialed this combination to appear in the left end of the window 18 as shown in FIG. 2, need only note the single face up card of the dealer and scan across the dealer's up card row 36 shown on the outer housing adjacent the window 18. Each of the possible eleven card values from two through ten (including face cards, also each valued at ten) and the ace, is shown in this row 36, with each card position corresponding to one of the recommended action columns 38 of the table 30.

In the event that the dealer's single face up card were a two, seven, or eight, the best odds for the player would occur if the player were to "stand" on his hand of the ace and seven, i. e., not accept further cards to increase the count of his or her hand. This is indicated by the "S" abbreviation appearing in the window 18, beneath these dealer up card values of the row 36.

If the dealer up card were a three, four, five, or six, the best course of action for the player would be to double (or "Double Down,") as indicated by the "DD" abbreviation appearing through the window 18 and beneath the three through six card positions of the dealer up card row 36.

The third alternative for the player holding an ace and seven is shown beneath the nine, ten, and ace positions of the dealer up card row 36, where the most favorable action by the player is to "hit," or draw another card in an attempt to exceed the potential value of the dealer's hand. This is indicated by the "H" symbol under the nine, ten, and ace positions of the dealer up card row 36.

One other possibility exists where the player has drawn a pair of cards each having the same value (i. e., a pair of fives, a ten and a king, etc.). In such a situation, it is often advisable to "split" the pair, with each card forming one card of a new hand. This is indicated by the abbreviation "SP" at various points on the table 30, opposite paired cards in the first column 32 designating the player's hand.

It will be understood that the above recommended actions are optimum according to the laws of probability and chance, but will not always result in a win for the player. Still, they reduce the chances of losing and provide the best odds of winning, when followed consistently.

Further convenience in the use of the present blackjack primer may be provided by color coding the different recommended action abbreviations of the table 30, as indicated in FIG. 4. For example, each of the "H" symbols may be colored blue, each of the "S" symbols violet or purple, each of the "DD" symbols orange, and each of the "SP" symbols yellow. Either the symbols or abbreviated characters themselves may be colored or shaded appropriately, or their background may be colored or shaded, as desired. It should be noted that the above described colors are exemplary, and that different colors may be used as desired. The legend 42 with its explanations of the symbols of the table 30 may be colored or shaded in a like manner, to enable the player to readily see the corresponding legend for the appropriate action.

In summary, the above described blackjack primer 10 will be seen to provide a most useful, and potentially valuable, aid for the player who enjoys the game of blackjack or twenty one. The device is quite simple to construct, basically comprising only an outer housing with a window, with an inner cylinder having a table of recommended actions thereon and a selection knob extending from each end of the housing, providing for the selective rotation of the inner cylinder and table to the desired position beneath the window of the outer housing. The device may include additional features, such as a keychain tab, a flat flange or base to preclude rolling, and other information (e. g., the admonition to "never take insurance," which is generally understood to be a poor wager for the player).

The present blackjack primer 10 is also quite economical to construct, as the various components thereof lend themselves quite nicely to casting or molding from plastic. The device may include advertising or other indicia thereon, and may be provided as a free or low cost souvenir provided by a hotel, tour line, or other establishment catering to the gambling trade. Even if purchased by the user, the low cost of the device will enable the user to save many times the initial cost of the device by optimizing his or her actions at the blackjack table, by using the present blackjack primer.

It is to be understood that the present invention is not limited to the sole embodiment described above, but encompasses any and all embodiments within the scope of the following claims.

We claim:

1. A blackjack primer for providing assistance in decision making for a player of the card games of blackjack and twenty one, comprising:

a generally cylindrical outer housing having a length and a diameter;

said outer housing including a single elongate window extending along the majority of said length thereof, and a dealer card row adjacent said window listing all possible face up cards which may be held by the dealer;

an inner cylinder disposed concentrically and rotatably within said outer housing, with said inner cylinder including a table affixed therearound;

said table including a column listing the count of all possible two card combinations which may be held by the player, and a plurality of rows of recommended actions, with each of said rows corresponding to one of said two card combination counts of said column, and;

said inner cylinder further having a first and an opposite second selection knob extending from opposite ends thereof and affixed thereto, with each said selection knob extending beyond said outer housing for turning said inner cylinder by the player for causing one of said two card combination values and a corresponding one of said rows of recommended actions to appear in said window of said outer housing as desired.

2. The blackjack primer according to claim 1, including a flat base disposed along said outer housing and generally opposite said window.

3. The blackjack primer according to claim 1, wherein said rows of recommended actions of said table each include a plurality of abbreviations comprising "H," "S," "SP," and "DD," respectively corresponding to actions comprising "hit," "stand," "split," and "double down."

4. The blackjack primer according to claim 3, including a legend disposed upon said outer housing, with said legend providing explanations of said abbreviations of said table.

5. The blackjack primer according to claim 1, wherein:

said rows of recommended actions of said table each include a plurality of abbreviations comprising "H," "S," "SP," and "DD," respectively corresponding to actions comprising "hit," "stand," "split," and "double down";

said outer housing includes a legend thereon, with said legend providing explanations of corresponding said abbreviations of said table, and;

said table and said legend of said outer housing are each color coded, with corresponding said abbreviations of said table and said explanations of said legend being colored with like colors.

6. The blackjack primer according to claim 1, wherein said window of said outer housing comprises a convex magnifying lens for enlarging said recommended actions listed upon said table.

7. The blackjack primer according to claim 1, wherein each said selection knob has a form for providing optimum grip for the player.

8. The blackjack primer according to claim 1, wherein said first selection knob includes a keychain attachment tab extending axially therefrom.

9. The blackjack primer according to claim 1, wherein said outer housing and said first and said second selection knob have a total length of substantially three and one half inches, and said outer housing has a diameter of substantially one inch.

10. The blackjack primer according to claim 1, wherein at least said outer housing, said inner cylinder, and each said selection knob are each formed of plastic.

11. A blackjack primer for providing assistance in decision making for a player of the card games of blackjack and twenty one, comprising:

an outer housing having a length and a width;

said outer housing including a single elongate window extending along the majority of said length thereof, and a dealer card row adjacent said window listing all possible face up cards which may be held by the dealer;

an inner cylinder disposed concentrically and rotatably within said outer housing, with said inner cylinder including a table affixed therearound;

said table including a column listing the count of all possible two card combinations which may be held by the player, and a plurality of rows of recommended actions, with each of said rows corresponding to one of said two card combination counts of said column and being selectively visible through said window of said outer housing, and;

said inner cylinder further having at least one selection knob extending from at least one end thereof and affixed thereto, with said at least one selection knob extending beyond said outer housing for turning said inner cylinder by the player for causing one of said two card combination values and a corresponding one of said rows of recommended actions to appear in said window of said outer housing as desired.

12. The blackjack primer according to claim 11, wherein said outer housing is cylindrical, and includes a flat base disposed along said outer housing and generally opposite said window.

13. The blackjack primer according to claim 11, wherein said rows of recommended actions of said table each include a plurality of abbreviations comprising "H," "S," "SP," and "DD," respectively corresponding to actions comprising "hit," "stand," "split," and "double down."

14. The blackjack primer according to claim 13, including a legend disposed upon said outer housing, with said legend providing explanations of said abbreviations of said table.

15. The blackjack primer according to claim 11, wherein said rows of recommended actions of said table each include a plurality of abbreviations comprising "H," "S," "SP," and "DD," respectively corresponding to actions comprising "hit," "stand," "split," and "double down";

said outer housing includes a legend thereon, with said legend providing explanations of corresponding said abbreviations of said table, and;

said table and said legend of said outer housing are each color coded, with corresponding said abbreviations of said table and said explanations of said legend being colored with like colors.

16. The blackjack primer according to claim 11, wherein:

said window of said outer housing comprises a convex magnifying lens for enlarging said recommended actions listed upon said table.

17. The blackjack primer according to claim 11, wherein said at least one selection knob has a form for providing optimum grip for the player.

18. The blackjack primer according to claim 11, wherein said at least one selection knob includes a keychain attachment tab extending axially therefrom.

19. The blackjack primer according to claim 11, wherein said outer housing and said at least one selection knob have a total length of substantially three and one half inches, and said outer housing has a width of substantially one inch.

20. The blackjack primer according to claim 11, wherein at least said outer housing, said inner cylinder, and each said selection knob are each formed of plastic.

* * * * *